United States Patent [19]

McLaughin, Sr.

[11] Patent Number: 4,575,152

[45] Date of Patent: Mar. 11, 1986

[54] PADDED MEMBER AND METHOD OF MAKING THE SAME

[76] Inventor: Thomas M. McLaughin, Sr., 515 N. Clay St., Mishawaka, Ind. 46544

[21] Appl. No.: 581,237

[22] Filed: Feb. 17, 1984

[51] Int. Cl.[4] ..... A47C 7/54

[52] U.S. Cl. ..... 297/411; 297/DIG. 1

[58] Field of Search ..... 297/411, 412, 419, 416, 297/227, 455, DIG. 1; 52/309.7, 309.16

[56] References Cited

U.S. PATENT DOCUMENTS

| | | | |
|---|---|---|---|
| 2,519,771 | 8/1950 | Lacore | 297/411 X |
| 3,634,925 | 1/1972 | Van Loo | 297/411 X |
| 3,717,527 | 2/1973 | Benteler | 264/46.9 |
| 4,212,097 | 7/1980 | Portinari et al. | 29/450 |
| 4,218,814 | 8/1980 | Hodapp | 29/450 |

FOREIGN PATENT DOCUMENTS

| | | | |
|---|---|---|---|
| 726468 | 1/1966 | Canada | 135/73 |
| 1249422 | 10/1971 | United Kingdom | 264/46.9 |

*Primary Examiner*—William E. Lyddane
*Assistant Examiner*—José V. Chen
*Attorney, Agent, or Firm*—Thomas J. Dodd

[57] ABSTRACT

A padded member including a beam support enclosed in a cushion and a method of making the same. The method includes providing a core having a projecting portion and partially encircled by a sleeve to assume the shape of a beam support, and molding a cushion about the core and sleeve to form an opening in the cushion spaced from the sleeve and a flexible cushion portion adjacent the opening accommodating flexing of the cushion for removal from the core and application to a beam support.

2 Claims, 7 Drawing Figures

PADDED MEMBER AND METHOD OF MAKING THE SAME

BACKGROUND OF THE INVENTION

This invention relates to a padded member and a method of making the same.

At the present time, a typical padded arm rest for a vehicle seat, for example, includes a cushion secured to a beam support and covered with an upholstery fabric. The beam support includes a post projecting therefrom, which is secured to a seat frame by a mounting bracket. A problem with such arm rests arises due to the fact that different vehicle manufacturers utilize different types of assemblies for securing the arm rest to the seat. This compels the producer of finished padded arm rests to keep a sizeable inventory of the different varieties of arm assemblies. A producer who wishes to cover and pad the beam supports, or arms, conventionally must fabricate many pieces together.

SUMMARY OF THE INVENTION

This invention allows a producer of cushions to maintain a relatively small inventory of each type of beam support or supports to be covered and to supply to producers of cushioned members the cushions to cover supports of all types. The cushion of this invention is formed of foam material which has incorporated therein a substantially rigid tube. An opening is formed in the cushion adjacent one end of the tube. When the end of the cushion adjacent the opening is bent relative to the tube containing end thereof, the cushion may be applied to encase a support in a position in which a projecting part of the support may be positioned within the opening when the cushion is returned to normal shape. A covering may then be applied over the padded member for decorative purposes.

The method of making the padded member of this invention includes the step of forming a cushion around a substantially rigid tube. A number of cushions may be molded upon and removed from a single mold or support and shipped to a seat producer who can assemble them to supports. The pad producer may keep an inventory of cushion units of different types to be delivered to a customer as orders specifying desired support types are received. A cushion unit, as described above, may be mounted upon a support of the type for which is was produced. The product of the invention can be applied to cushion an arm rest, a headrest or any type of cushioned member.

It is an object of this invention to provide a novel and useful padded member and a method of making the same.

Another object is to provide a method of making a cushion which eliminates the necessity for the cushion producer to maintain large inventories of different styles of supports which are to be covered.

Another object is to provide a padded arm rest in which padding may be assembled easily and quickly.

Other objects of this invention will be apparent upon a reading of the following description.

DESCRIPTION OF THE PREFERRED EMBODIMENT

Figure 1:
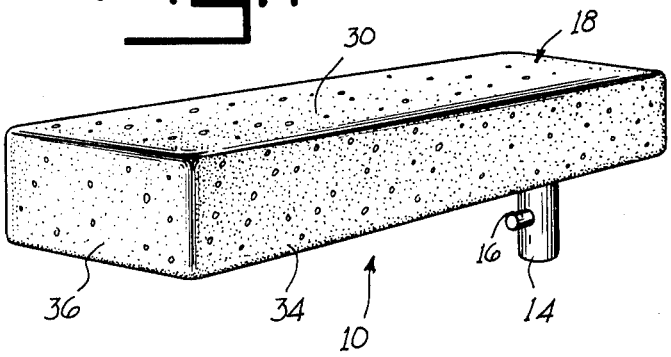
FIG. 1 is a top perspective view of a padded arm rest.
Figure 2:
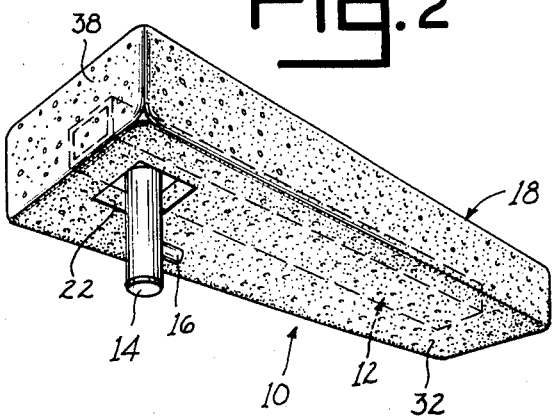
FIG. 2 is a bottom perspective view of the arm rest.
Figure 3:
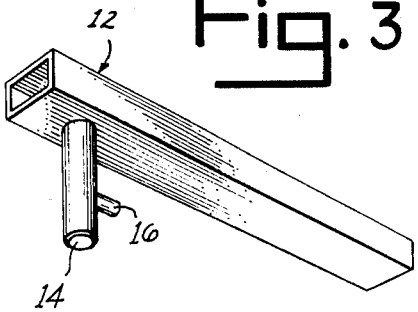
FIG. 3 is a perspective view of a typical support to be padded.

The preferred embodiment illustrated is not intended to be exhaustive or to limit the invention to the precise form disclosed. It is chosen and described to explain the principles of the invention and its application and practical use, to thereby enable others skilled in the art to utilize the invention.

The padded product of this invention is illustrated as an arm rest 10 which includes a support 12 which carries a projecting part 14, as a post with a latch 16, for mounting the arm rest to a seat frame (not shown) in swivelling cantilevered fashion. Support 12 is preferably rigid. Arm rest 10 also includes a cushion 18 which is preferably formed of a flexible foam material, such as polyurethane. The density of cushion 18 may be varied by any number of well known methods, such as using a filler, nucleation, or packing of composition in the mold. Cushion 18 is tubular and includes top wall 30, bottom wall 32, side walls 34, and end walls 36 and 38. Cushion 18 has a substantially rigid tube or member 20 incorporated therein and extending for a part of the length thereof. Tube 20 is preferably formed of a polyvinyl chloride (PVC) plastic or material having a sufficient wall thickness to impart rigidity to the tube. An opening 22 is formed in one wall, such as the bottom wall 32 of cushion 18 between the end of tube or sleeve 20 and the cushion end wall 38 to accommodate projection of post 14 from bottom wall 32 when support 12 is fitted within the cushion.

Figure 4:
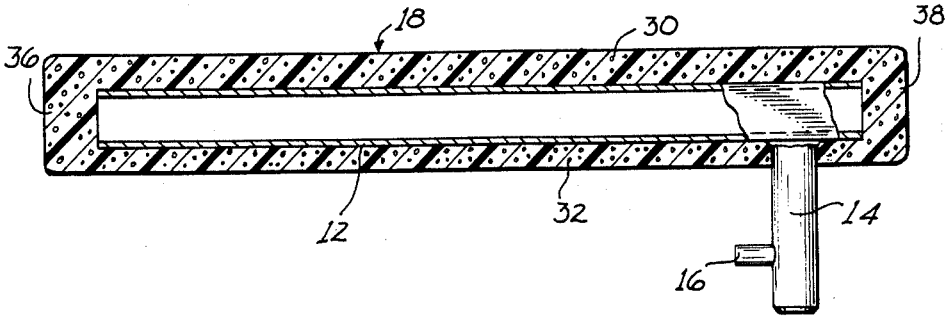
Fig. 4 (PRIOR ART)
FIG. 4 is a longitudinal sectional view of an arm rest showing a prior art construction.
Figure 5:
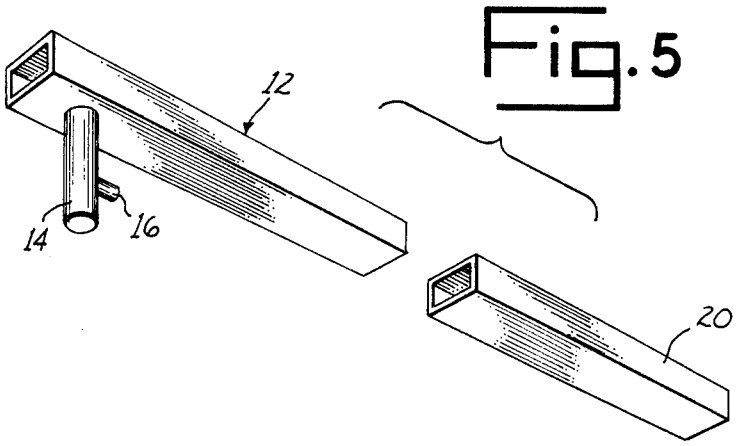
FIG. 5 is a perspective view of a support and a tube adapted to be applied to the support when a cushion is formed on the tube.

Prior art methods of forming arm rests and other padded members include molding a foam cushion directly onto a support 12. The product of this prior method is illustrated in FIG. 4. The method of this invention includes using a core of the shape of the selected support about which plastic tube or sleeve 20 is molded. If tube or sleeve 20 is molded on the core, a coating of a lubricant such as wax, silicone or other core release material is applied to the core before the formation of each tube or sleeve 20 thereon. Cushion 18 may be formed about the tube or sleeve 20 and the core by a molding operation wherein the tube or sleeve 20 is secured within the cushion. As mentioned above, the density of cushion 18 may vary and depends on a variety of factors, such as varying material indexes, use of an inert filler, use of reactive additives, nucleation, or packing of the molded composition into the mold. Tube or sleeve 20 must remain hollow during the formation of cushion 18.

Opening 22 is formed in the cushion adjacent one end of tube having a projection which depends from the core in the shape of the opening 20 during molding of the cushion around a core (not shown) of a shape similar to support 12. The opening 22 permits flexing of the end portion of the cushion, as shown in dotted lines in FIG. 6 to permit removal thereof from the core and later mounting on a support 12. Any number of cushion and tube units may be formed from one core in preparation for later assembly upon supports 12 as required. This eliminates the need for the pad, or cushion, producer to maintain a large inventory of supports on which pads are individually molded and permanently retained.

Figure 6:
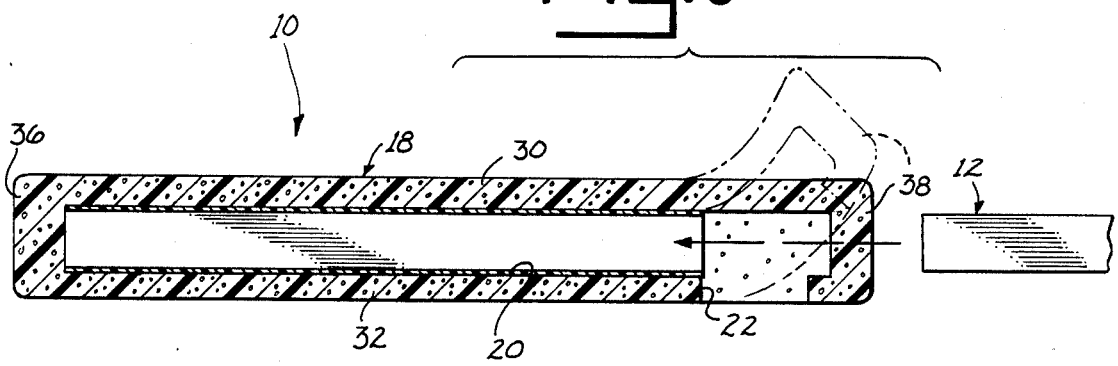
FIG. 6 is a longitudinal sectional view of the novel cushion and tube assembly about to have a support applied.
Figure 7:
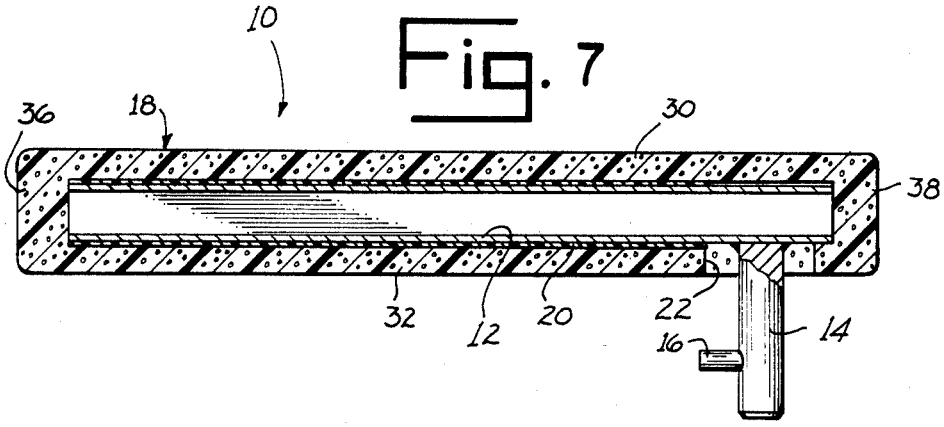
FIG. 7 is a longitudinal sectional view of the novel assembled padded arm rest.

Assembly of a support with a cushion and tube unit is illustrated in FIG. 6. It includes bending of cushion 18 adjacent to opening 22 to expose an open end of tube or sleeve 20. Support 12 is inserted into tube or sleeve 20 until properly positioned, at which time cushion 18 is returned to its normal position where its end wall 38 fits over the end of the support adjacent post 14 which is positioned within opening 22.

It is to be understood that the invention is not to be limited by the terms of the above description, but may be modified within the scope of the appended claims.

I claim:

1. A cushion for a member having a projecting part adapted to be secured to a support, said cushion comprising a foam member having an interior cavity, a substantially rigid tubular member positioned within said cavity and extending for a portion of the length of said cavity whereby said tubular member terminates spaced from an end edge of said cavity, said foam member having an aperture extending into said cavity adjacent said foam member one end edge to accommodate flexing of the apertured portion of said foam member for insertion of a support into said cushion and reception of said projecting part through said aperture when said cushion is positioned to enclose said support.

2. A method of making a cushion for enclosing a support member to be padded, said support member having a mounting means extending therefrom for mounting said cushion to a support, said method comprising the steps of:

(a) providing a core which conforms generally to the shape of said support member, with said core including a projection adjacent one end of the core, (b) positioning a substantially rigid sleeve about a portion of said core, said sleeve spacedly positioned from said core projection, (c) molding a foam cushion about said core and sleeve wherein the core and sleeve are enclosed and an opening is formed by said core projection, (d) flexing said cushion adjacent said core projection, (e) removing said core from within said cushion to create a void therein, and (f) inserting said support member within said void, wherein said mounting means projects through the opening in said cushion.

* * * * *